US005566786A

United States Patent [19]

De Angelis et al.

[11] Patent Number: 5,566,786

[45] Date of Patent: Oct. 22, 1996

[54] CABLE AS SUSPENSION MEANS FOR LIFTS

[75] Inventors: Claudio De Angelis, Root; Ernst Ach, Ebikon, both of Switzerland

[73] Assignee: Inventio AG, Hergiswil NW, Switzerland

[21] Appl. No.: 393,073

[22] Filed: Feb. 23, 1995

[30] Foreign Application Priority Data

Mar. 2, 1994 [WO] WIPO ..... PCT/CH94/00044
Aug. 23, 1994 [CH] Switzerland ..... 02578/94

[51] Int. Cl.[6] ..... B66B 11/08

[52] U.S. Cl. ..... 187/266; 57/232

[58] Field of Search ..... 187/266, 406, 187/411; 57/232, 231, 250, 258

[56] References Cited

U.S. PATENT DOCUMENTS

| | | | |
|---|---|---|---|
| 3,101,130 | 8/1963 | Bianca | 187/266 |
| 4,022,010 | 5/1977 | Gladenbeck et al. | 57/149 |
| 4,202,164 | 5/1980 | Simpson et al. | 57/232 |
| 4,640,179 | 2/1987 | Cameron | 57/232 |

FOREIGN PATENT DOCUMENTS

| | | |
|---|---|---|
| 0252830 | 1/1988 | European Pat. Off. . |
| 2292071 | 6/1976 | France . |
| 0495911 | 10/1970 | Switzerland . |

OTHER PUBLICATIONS

European Search Report and Annex.
Research Disclosure No. 214, Feb. 1982, Havant Hampshire, Great Britain, p. 54, item 2138.

*Primary Examiner*—Kenneth Noland
*Attorney, Agent, or Firm*—Greenblum & Bernstein P.L.C.

[57] ABSTRACT

Cable as suspension means for lifts. A synthetic fiber cable is connected with an elevator car or load-receiving means, with a sheathing, surrounding an outermost cable strand layer, consisting of synthetic material, preferably polyurethane, with the cable strands being twisted or laid up of individual aramide fibers, wherein each individual strand is treated with an impregnating medium for the protection of the fibers and a friction-reducing intermediate sheathing is interposed between the outermost strand layer and the inner strand layer, and in order to obtain an almost circularly shaped strand layer and increase the degree of filling of the strands, any gaps therein are augmented by filler strands.

24 Claims, 3 Drawing Sheets

CABLE AS SUSPENSION MEANS FOR LIFTS

CROSS REFERENCE TO RELATED APPLICATIONS

This application claims the priority of International Patent Application PCT/CH 94/00044, filed Mar. 2, 1994 and Swiss Patent Application CH 2578/94-3, filed Aug. 23, 1994, the disclosures of which are incorporated herein by reference in their entireties.

BACKGROUND OF THE INVENTION

1. Field of the Invention

The invention pertains to a cable as suspension means for lifts or elevators, which is connected with an elevator car or a load-receiving means, wherein the cable consists of synthetic fibers.

2. Discussion of the Background of the Invention and Material Information

Until recently, steel cables were used in elevator construction, which cables are connected with the elevator cars or the load-receiving means and counterweights, in the simplest case in the ration of 1:1. The use of steel cables, however, entails some disadvantages. Due to the high inherent weight of the steel cable, limits exist with respect to the lifting height of an elevator installation. Furthermore, the co-efficient of friction or frictional value between the metallic drive pulley and the steel cable is so low that the frictional value must be increased by different measures, such as special groove shapes or special groove linings in the drive pulley, or through an increase of the loop angle. Beyond that, the steel cable acts as a sound bridge between the drive and the elevator car, which entails a reduction in travelling comfort. In order to reduce these undesired effects, expensive constructional measures are required. Moreover, steel cables in comparison with the synthetic fiber cables, can absorb a lower number of bending cycles, are exposed to corrosion and must be regularly maintained.

An inlay ring for lining the wire cable grooves of cable rollers for cable railways and elevators, wherein the inlay ring consists of an elastic material for the damping of noises and for the preservation of the wire cables, is set forth in Swiss Patent Publication CH-PS 495 911. In order to assure better removal of the internal heat, the inlay ring is built up of several individual segments spaced from one another. The expansion of the inlay ring, which takes place as a consequence of heating, is compensated for by spacings between the individual segments. Upon loading of the wire cable, the elastic material can deviate or yield into the adjacent incisions and is thereby relieved to a certain extent so that no tears occur in the cable groove. In the case of localized wear of the inlay ring, individual segments must be replaced.

In the previously invention, a steel cable is still used as suspension means, with the steel cable still displaying the initially-mentioned disadvantages. Furthermore, the elastic inlay is worn very quickly due to the small length of the running surface of the cable roller in relation to the length of the steel cable and must thus be replaced frequently, which entails high maintenance costs.

SUMMARY OF THE INVENTION

It is the task or object of this invention to provide a cable, as a suspension means for elevators of the initially described type, which does not suffer from the aforementioned disadvantages and by means of which the travel comfort is increased.

This object is achieved by this invention in the manner set forth in the appended claims.

Specifically, a cable serves as a suspension means for elevators, with the cable being connected with one of an elevator car and a load receiving means and driven via one of a drive pulley and a winch, wherein carrying strands of the cable consist of synthetic fibers, with the synthetic fibers being surrounded by a closed annular sheathing of synthetic material. Preferably, the synthetic material is polyurethane.

In a further embodiment of the cable of this invention, the binding forces between an outermost strand layer of the cable and the sheathing are greater than the shear forces arising between the drive pulley and the sheathing.

In another embodiment of the cable of this invention, the binding forces between an outermost strand layer of the cable and the sheathing are greater than the shear forces arising between the drive pulley and the sheathing, and wherein the carrying strands are impregnated with a predetermined impregnating medium. Preferably, the predetermined medium is a polyurethane solution.

In a differing embodiment of the cable of this invention, the binding forces between an outermost strand layer of the cable and the sheathing are greater than the shear forces arising between the drive pulley and the sheathing, and wherein the carrying strands are surrounded by a braided sleeve of polyester fibers.

In still a further embodiment of the cable of this invention, a friction-reducing intermediate sheath is interposed between the outermost strand layer and an inner strand layer of the cable.

In still another embodiment of the cable of this invention, the carrying strands of an inner strand layer of the cable are treated with silicone.

In still a differing embodiment of the cable of this invention, the surface of the sheathing is smooth.

In yet a further embodiment of the cable of this invention, the surface of the sheathing is textured.

In yet another embodiment of the cable of this invention, the carrying strands of the cable consist of twisted aramide fibers.

In yet a differing embodiment of the cable of this invention, the carrying strands of the cable consist of laid out aramide fibers.

The advantages achieved by this invention reside in the fact that a sheathed synthetic fiber cable, which consists of several layers, with the strands thereof, which may be treated or untreated by an impregnating medium, in comparison with steel cables, displays a substantially higher load carrying capacity and is almost maintenance free.

The sheathing of the synthetic fiber cable produces higher co-efficients of friction on the drive pulley so that the looping thereof can be reduced. The co-efficient of friction can be influenced by differing the properties of the sheathing surface. Thereby, the drive pulleys can be standardized, since different groove shapes are no longer needed. For steel cables, the drive pulley diameter is forty times the cable diameter. Via the use of synthetic fiber cables and due to its properties, the drive pulley diameter can be chosen to be significantly smaller. Synthetic fiber cables, in comparison with steel cables, permit a substantially greater number of bending changes for the same diameter conditions. Due to the low weight of the synthetic fiber cable, in comparison with a steel cable, apart from a reduction in the number of balancing cables, a substantially lower weight tensioning weight can also be used. Due to the aforementioned improvements, smaller required starting torques and turning moments are required for the design of the drive, which consequently lowers both the staring current and the overall energy requirements. Thereby, the overall size of drive motors can be reduced. Moreover, no frequency transmissions take place in a cable of this type of construction so that there are no excitations of the elevator car via the cable, which, apart from an increase in the travelling comfort, also permits a reduction in the constructional measures required for the isolation of the elevator car.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
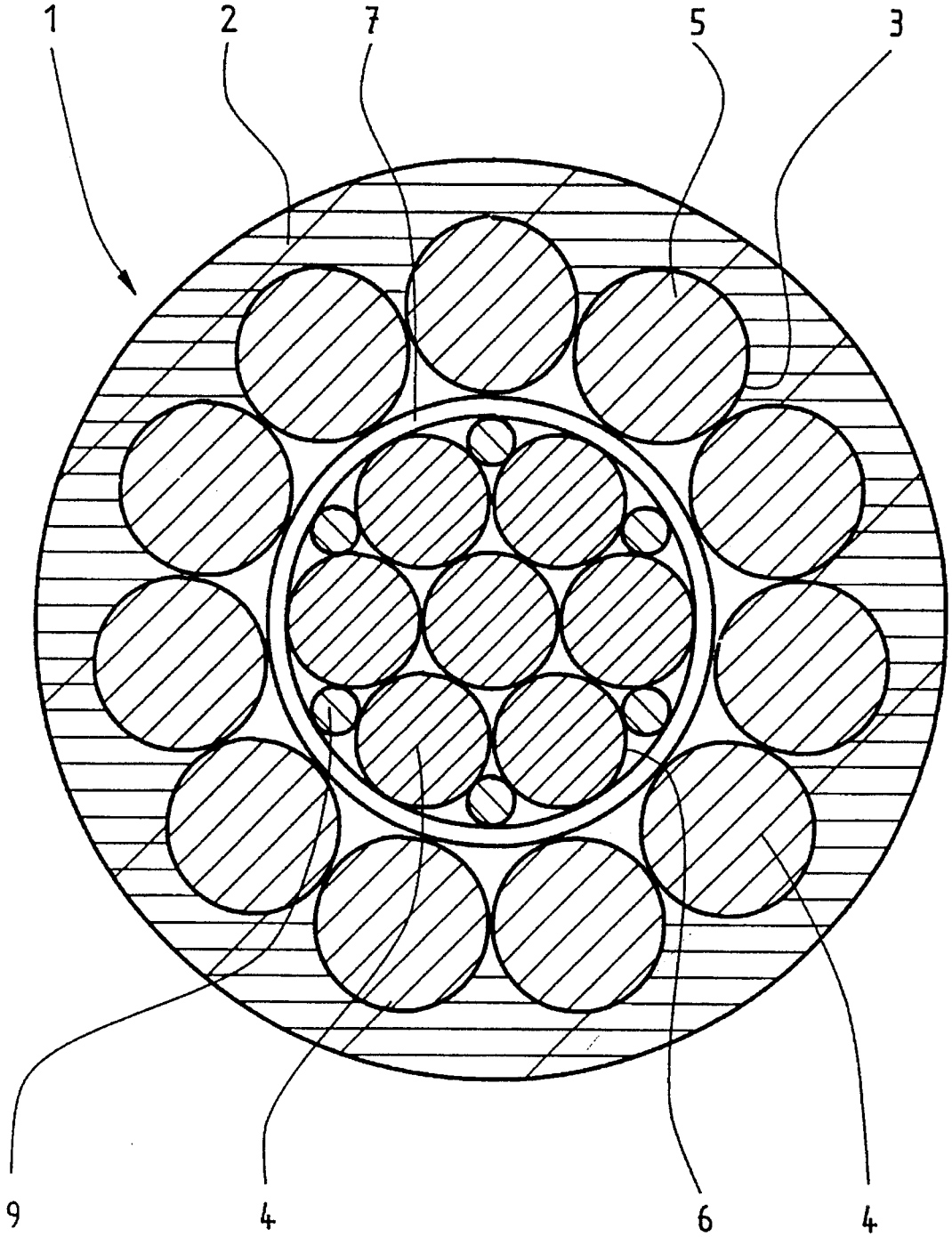
FIG. 1 is a vertical section through the synthetic fiber cable of this invention.

FIG. 1 is a section through a synthetic fiber cable 1 according to the invention. A sheathing 2 surrounds an outermost strand layer 3, with sheathing 2 being of synthetic material, preferably polyurethane, increasing the friction value or co-efficient of friction of the cable 1 on the drive pulley. The outermost strand layer 3 must display such high binding forces to sheathing 2, that the latter is not displaced or forms upset portions or banks due to the shear forces arising during the loading of cable 1. These binding forces are achieved in that the synthetic material sheathing 2 is sprayed or extruded, for example, onto the fiber cable so that all intermediate spaces between the strands 4 are fully filled and a large retaining surface is formed. Strands 4 are twisted or laid out of individual aramide fibers 5. Each individual strand 4 is treated with an impregnating medium, for example a polyurethane solution, for the protection of fibers 5. The bending fatigue strength of cable 1 is dependent on the portion or share of polyurethane at each strand 4. The higher the portion or share of the polyurethane, the higher becomes the bending fatigue strength. However, the carrying capability and the modulus of elasticity of synthetic fiber cable 1 fall with increasing portions of polyurethane. The polyurethane utilized for the impregnation of strands 4 can, according to desired bending fatigue strength, vary, for example, between 10 and 60%. Expediently, the individual strands 4 can also be protected by a braided sleeve of polyester fibers.

In order to avoid wear of the strands due to mutual friction, one against the other, on the drive pulley, a friction-reducing intermediate sheathing 7 is applied, for that reason, between outermost strand layer 3 and an inner strand layer 6. The same friction-reducing effect can be achieved via the treatment of the underlying strands 4 with silicone. Thereby, wear is kept low at the outermost strand layer 3 and at the inner strand layer 6 which, during the bending of the cable at the drive pulley, perform most of the relative movements. Another means for the prevention of frictional wear at the strands 4 could take the form of an elastic filler mass which interconnects the strands 4 without excessively reducing the flexibility of cable 1.

In contrast to pure holding cables, lift or elevator cables must be very compact and firmly twisted or braided in order that they do not deform on the drive pulley or start to turn in consequence of their own twist or deflection. The gaps and hollow spaces between the individual layers of the strands 4 are therefore filled by means of filler strands 9, which can act in a supporting manner against other strands 4, in order to obtain an almost circularly shaped strand layer 6 and to increase the degree of filling. These filler strands 9 preferably consist of a synthetic material, for example of polyamide.

Aramide fibers 4, consisting of high-grade or highly oriented molecule chains, display a high tensile strength. In contrast to steel, aramide fiber 4 however has a rather low lateral or transverse strength by reason of its atomic structure. For this reason, no conventional steel cable joints can be used for the cable end fastening of synthetic fiber cables 1, since the clamping forces acting in these components greatly reduce the breaking load of cable 1. A suitable cable end connection for synthetic fiber cables 1 has already become known through International Patent Application PCT/CH94/00044 which is also assigned to the assignee of this invention.

Figure 2:
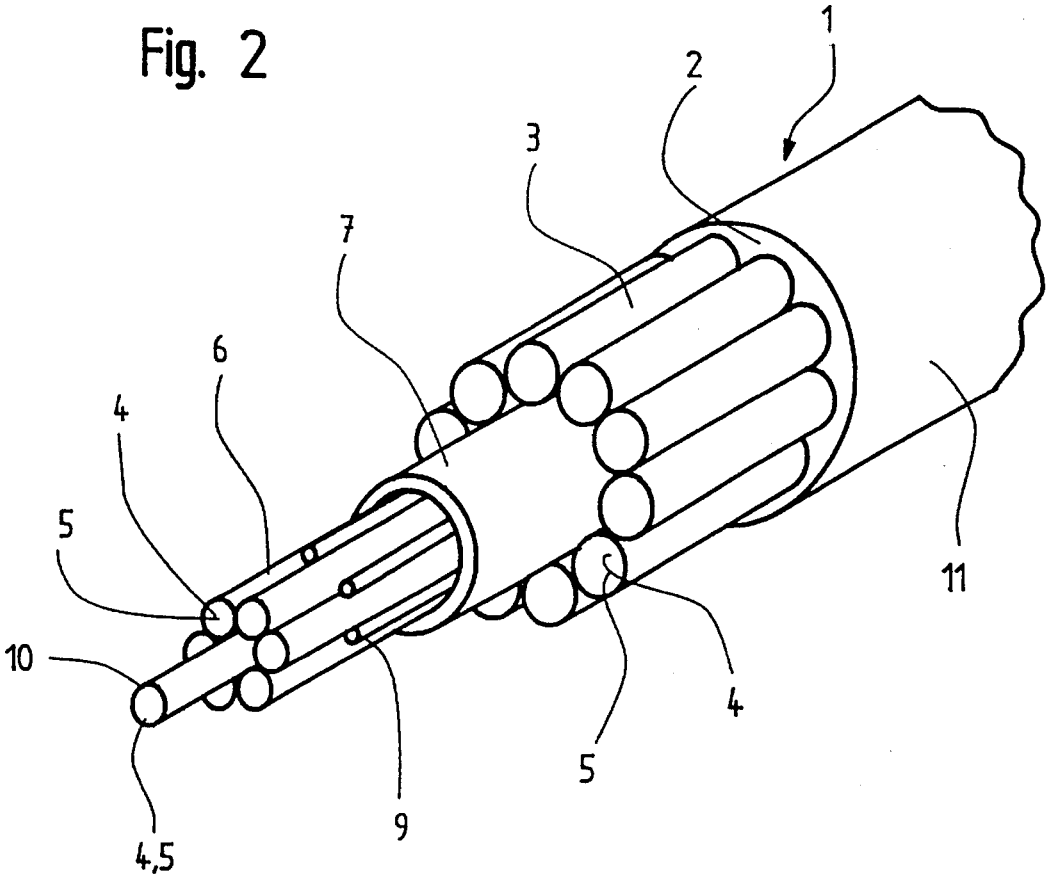
FIG. 2 is a perspective illustration of the synthetic fiber cable of this invention.

FIG. 2 is a perspective illustration of the build-up of synthetic fiber cable 1 of this invention. Strands 4, which are twisted or laid up of aramide fibers 5, are laid inclusive of filler strands 4, in left-hand or right-hand layers around a core 10. The friction-reducing intermediate sheathing 7 is arranged between one of the inner layers and the outermost strand layer 3. The outermost strand layer 3 is covered by sheathing 2. In order to achieve a defined or predetermined frictional value, surface 11 of sheathing 2 can be textured. The task of the sheathing 2 consists of assuring the desired frictional values relative to the drive pulley and to protect strands 4 against mechanical and chemical damages as well as ultraviolet rays. The load is carried exclusively by strands 4. Cable 1, built up of aramide fibers 5, in comparison with a steel cable of the same cross section, has a substantially higher load carrying capacity and only one fifth to one sixth of the specific weight thereof. For the same load carrying capacity, the diameter of a synthetic fiber cable 1 can therefore be reduced in comparison with a conventional steel cable. Through the use of the aforementioned materials, cable 1 is totally protected against corrosion. Maintenance like that for steel cables, for example in order to grease same, is no longer necessary.

Another form or embodiment of synthetic fiber cable 1 consists of a different design of sheathing 2. Instead of using a sheathing 2 to enclose the entire outermost strand layer 3, each individual strand 4 is provided with a separate, annular closed casing, preferably of polyurethane or polyamide. The further build-up or construction of synthetic fiber cable 1, however, remains identical with the form or embodiment described in FIGS. 1 and 2.

Figure 3:
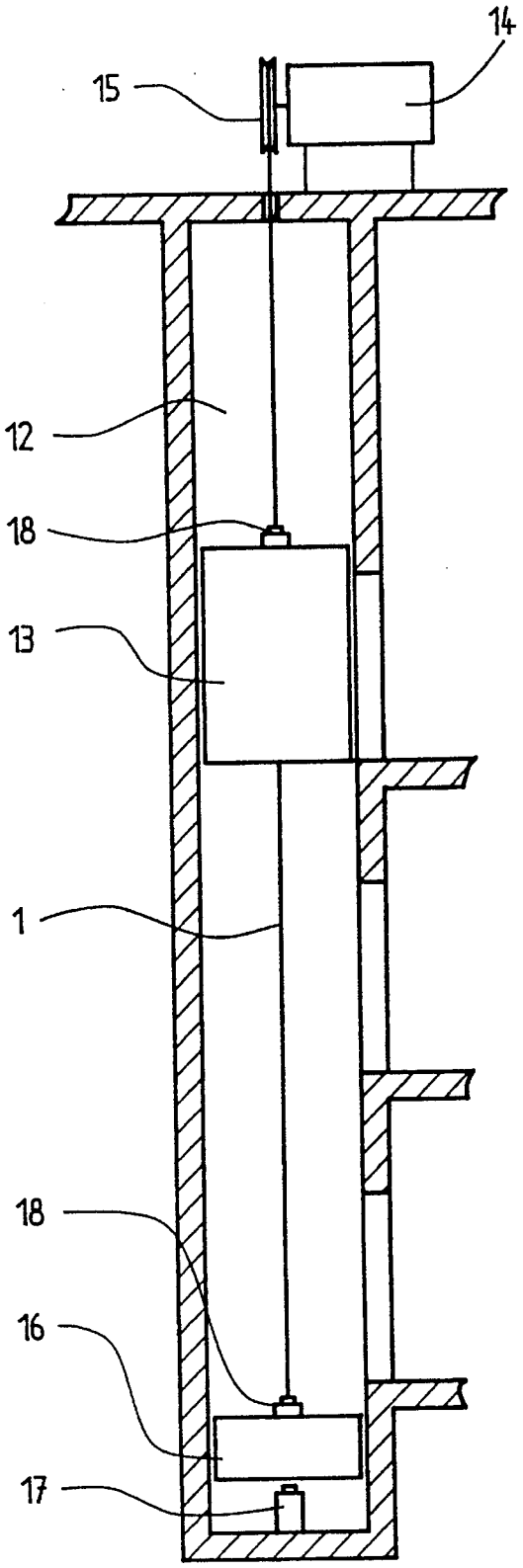
FIG. 3 is a schematic illustration of an elevator installation.

FIG. 3 is a schematic illustration of an elevator plant or installation. A cage or elevator car 13, guided in a lift shaft 12, is driven via synthetic fiber cable 1, in accordance with the invention, by a drive motor 14 with a drive pulley 15. A counterweight 16 hangs or is suspended as a balancing element at the other end of cable 1. The frictional value between cable 1 and drive pulley 15 is now so chosen that a further conveying of car 13 is prevented when the counterweight 16 has set down or bottomed out on a buffer 17. The fastening of cable 1 onto cage 13 and to counterweight 16 takes place via cable end connections 18.

When the drive is occasioned by the use of a linear motor mounted on the counterweight or on the car, the co-efficient of friction or the frictional value between cable 1 and a deflecting or return pulley should be as small as possible in order to keep the frictional losses to a minimum. The deflecting pulley in this case transmits no driving torque to cable 1. For this purpose, sheathing 2 can, in place of polyurethane, also consist of polyamide in order to reduce the frictional value or co-efficient of friction.

Figure 4:
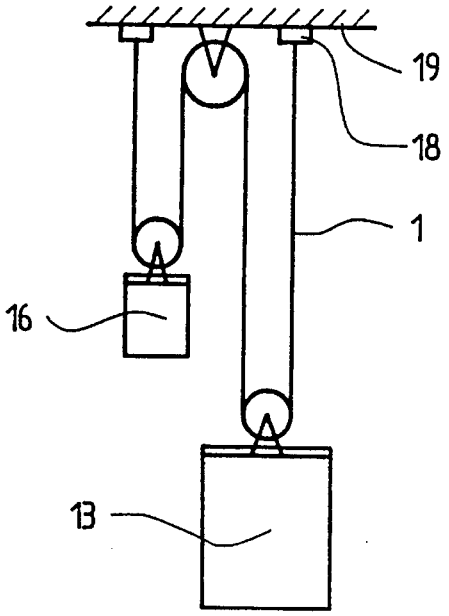
FIG. 4 is a schematic illustration of an elevator installation having a suspension ratio of 2:1.

FIG. 4 shows a schematic illustration of an elevator installation with a suspension ration of 2:1. Cable end connections 18 for synthetic fiber cable 1 are, in this arrangement, not mounted on car 13 and on counterweight 16, but each time at upper shaft end 19.

Figure 5:
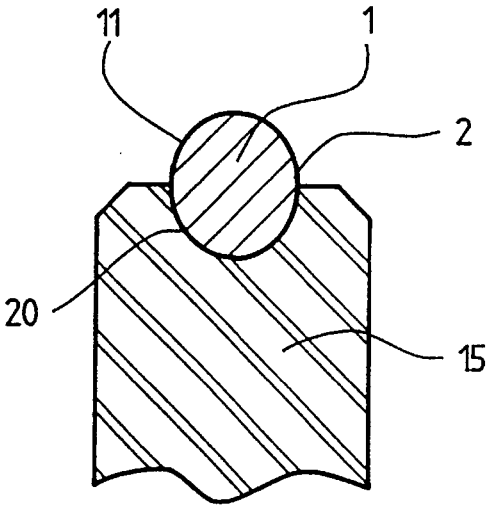
FIG. 5 shows, in cross-section, a detail of a drive pulley in combination with a synthetic fiber cable of this invention.

FIG. 5 shows, in cross section, synthetic fiber cable 1 of this invention on drive pulley 15. The shape of a groove 20 of drive pulley 18, coupled to elevator drive motor 14, is preferably semicircular for an optimum adaptive contact with cable 1. Since, under load, cable 1 becomes somewhat deformed at the contact surface, an oval groove shape can also be chosen. These simple groove shapes can be used, since synthetic material casing 2 produces a sufficiently high co-efficient of friction. At the same time, by reason of the high co-efficients of friction, the looping angle of cable 1, at the drive pulley 15, can be reduced. The groove shape of drive pulley 15 can be constructed identically for elevators subjected to different loads, since the co-efficient of friction is determined by the surface structure 11 and material of sheathing 2. Thereby, in an individual case, excessive friction can also be reduced in order to prevent a load conveyance when the counterweight is set down or bottomed out (set-down test). In addition, the dimensions of drive pulley 15 can be reduced by reason of the lower cable diameter of synthetic fiber cable 1 and the smaller possible drive pulley diameter associated therewith. A smaller drive pulley diameter leads to a smaller driving torque and thereby to a smaller motor size. In addition, the production and inventory of drive pulleys 15 is also simplified and substantially reduced in cost. Due to the large bearing surface of cable 1 in groove 20, smaller area pressures likewise arise, which appreciably prolong the service life of cable 1 and drive pulley 15. Cable 1, being produced of aramide fibers, moreover permits no transmission of the frequencies emanating from drive pulley 15. Thus, any excitations, which would reduce the travelling comfort of car 13, by way of cable 1, disappear.

Further reductions in the region of the drives be realized due to the increased co-efficient of friction, the smaller looping angle and the lower weight of synthetic fiber cable 1. The required starting or running torques and the torques at the shaft of the driving machines are markedly reduced. Consequently, the starting currents and the entire energy requirement, are reduced. This, in turn, permits a reduction in the motor and gear sizes as well as the overall size of the transformers that feed the motors.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A cable serving as suspension means for elevators, with the cable connected with one of an elevator car and a load receiving means and driven via one of a drive pulley and a winch, wherein carrying strands of the cable are comprised of synthetic fibers, with the synthetic fibers being surrounded by a closed annular sheathing of synthetic material which fills an intermediate space between the carrying strands.

2. The cable of claim 1, wherein the synthetic material is polyurethane.

3. The cable of claim 1, wherein the carrying strands are impregnated with a predetermined impregnating medium.

4. The cable of claim 3, wherein the predetermined medium is a polyurethane solution.

5. The cable of claim 1, wherein the surface of the sheathing is smooth.

6. The cable of claim 2, wherein the surface of the sheathing is smooth.

7. The cable of claim 3, wherein the surface of the sheathing is smooth.

8. The cable of claim 4, wherein the surface of the sheathing is smooth.

9. The cable of claim 1, wherein the surface of the sheathing is textured.

10. The cable of claim 2, wherein the surface of the sheathing is textured.

11. The cable of claim 3, wherein the surface of the sheathing is textured.

12. The cable of claim 4, wherein the surface of the sheathing is textured.

13. The cable of claim 1, wherein the carrying strands of the cable are comprised of twisted aramide fibers.

14. The cable of claim 2, wherein the carrying strands of the cable are comprised of twisted aramide fibers.

15. The cable of claim 3, wherein the carrying strands of the cable are comprised of twisted aramide fibers.

16. The cable of claim 4, wherein the carrying strands of the cable are comprised of twisted aramide fibers.

17. The cable of claim 5, wherein the carrying strands of the cable are comprised of twisted aramide fibers.

18. The cable of claim 9, wherein the carrying strands of the cable are comprised of twisted aramide fibers.

19. The cable of claim 1, wherein the carrying strands of the cable are comprised of laid out aramide fibers.

20. The cable of claim 2, wherein the carrying strands of the cable are comprised of laid out aramide fibers.

21. The cable of claim 3, wherein the carrying strands of the cable are comprised of laid out aramide fibers.

22. The cable of claim 4, wherein the carrying strands of the cable are comprised of laid out aramide fibers.

23. The cable of claim 5, wherein the carrying strands of the cable are comprised of laid out aramide fibers.

24. The cable of claim 9, wherein the carrying strands of the cable are comprised of laid out aramide fibers.

* * * * *